United States Patent [19]

McClure

[11] 3,987,971

[45] Oct. 26, 1976

[54] ROCK CRUSHER

[76] Inventor: Orlie Bob McClure, 25 Ellsworth Lane, St. Louis, Mo. 63124

[22] Filed: Apr. 7, 1975

[21] Appl. No.: 565,866

Related U.S. Application Data

[63] Continuation-in-part of Ser. No. 464,814, April 29, 1974, abandoned.

[52] U.S. Cl. ..... 241/73; 241/186 R; 241/194

[51] Int. Cl.[2] ..... B02C 13/04

[58] Field of Search ..... 241/73, 88.2, 88.4, 241/89.1, 89.2, 186 R, 189 R, 190, 191, 193, 194, 195, 101.7

[56] References Cited

UNITED STATES PATENTS

| | | | |
|---|---|---|---|
| 1,037,232 | 9/1912 | Frickey | 241/89.1 |
| 1,103,219 | 7/1914 | Ogden | 241/89.1 |
| 1,182,835 | 5/1916 | Campen et al. | 241/88.2 |
| 2,558,107 | 6/1951 | Smith | 241/197 |
| 3,278,126 | 10/1966 | Ratkowski | 241/195 |
| 3,662,963 | 5/1972 | McClure | 241/186 R |
| 3,841,570 | 10/1974 | Quinn | 241/101.7 |

*Primary Examiner*—Granville Y. Custer, Jr.
*Attorney, Agent, or Firm*—John D. Pope III

[57] ABSTRACT

An impact type rock crusher having a rotor comprised of a plurality of stirrup type hammers adapted to swing through arcs of approximately 180° between bumper blocks about pivot axes as well as rotating about the main shaft of the rotor. The grate positioned beneath the rotor through which the crushed material exits may be moved uniformly radially with regard to the rotor to an alternate grate position to vary the clearance between the hammers and the top surface of the grate. The overall design of the system reduces the height of the apparatus, and the apparatus may be made portable for movement from one location to another.

8 Claims, 7 Drawing Figures

ROCK CRUSHER

This is a continuation-in-part of application Ser. No. 464,814, filed Apr. 29, 1974 now abandoned.

Conventional rock crushing machines include a rotor rotatably mounted in a crushing chamber. The rotor includes hammers which define hammer tip circles as the rotor rotates. A plurality of breaker bars forming the internal surface of the chamber are adapted to facilitate the breaking up of the rocks as they are impelled and battered by the hammers. A feed chute usually leads to an opening at the upper end of the crushing chamber for gravity feeding of the material to be crushed. One such rock crusher is disclosed and claimed in my U.S. Pat. No. 3,662,963 issued May 16, 1972.

One of the principal novel aspects of the present invention relates to an improved rotor construction for sizing impact type rock crushers. Conventional rock crushers of this type utilize hammers each comprising a single bar extending the length of the rotor element and solidly attached at the ends of the rotor. Difficulties have been experienced in using such hammers and on occasion disasterous results occurred when heavy tramp metal objects inadvertently were fed into the crushing chamber. In lieu of such single piece hammers, the present invention utilizes a plurality of hinged, readily replaceable stirrup type hammers arranged in series, which hammers are swingable about pivot axes rotating about the main shaft of the rotor. The hammers swingable about a given axis each extend only a portion of the length of the rotor and are separated from the adjacent hammer by a cylinrical spacer block. The diameter of the spacer blocks is such that the working surfaces of the hammers extend radially outwardly beyond the periphery of the spacer blocks during the normal operating stroke of the hammers. However, upon contacting tramp metal or like obstruction, the hammers may move towards an inoperative position in which the hammers are located essentially within the periphery of the spacer discs. This arrangement of the hammers minimizes the possibility of danger to the apparatus in emergency situations, and facilitates movement of tramp metal to a location in which it may be cleared from the crushing chamber.

Another principal aspect of the invention resides in provision of apparatus to enable the arcuate grate beneath the rotor to be moved uniformly inwardly and outwardly to different settings along a radius with respect to the rotor so that the gap between the normal operating hammer tip and the top surface of the grate may be varied uniformly over essentially the entire surface of the grate. In present constructions, the grate is normally fixed in position. With changes in the grate openings, a variety of particle sizes can be obtained. However, there is a desired coarse size which cannot be obtained because regardless of the grate hole size, the hammer will split a coarse particle in two against the next bar before the particle can fall through the hole in the grate. With the adjustable grate setting of the present invention, the clearance between the tips of the hammers and the grate bars can be changed to alleviate this problem.

The overall arrangement of the rock crusher of this invention is designed to minimize the vertical height of the complete unit including the chassis or other support on which the crusher is mounted and the discharge conveyor provided at the exit from the discharge chamber of the crusher. For example, a portable crusher of the present invention may be constructed with an overall height of only slightly more than 14'. A state permit to move a machine of this height is readily obtainable. By providing a discharge chamber with sides sloping at least 50° from the horizontal, which discharge chamber begins at the base of the crusher assembly, the tendency for the material being discharged from the unit to stick and clog in the discharge chamber is minimized without adversely penalizing the overall height of the apparatus.

Among the several objects of the present invention, there may be noted in particular the provision of a novel rotor construction including a plurality of stirrup type hammers; the provision of an arrangement to enable the hammers to swing to an inoperative position in emergency situations; the provision for alternate grate settings to adjust the clearance between the grate and the tips of the hammers during normal operation; and the provision of a rock crusher unit having minimized overall height. Other objects and features will be in part apparent and in part pointed out hereinafter.

The invention accordingly comprises the constructions hereinafter described, the scope of the invention being indicated in the following claims.

In the accompanying drawings, in which a presently preferred embodiment of the invention is illustrated, FIG. 1 is a vertical cross-sectional view of a rock crusher in accordance with the invention with the grate bars resting on an alternate grate setting ledge;

Corresponding reference characters indicate corresponding parts throughout the several views of the drawings.

Figure 1:
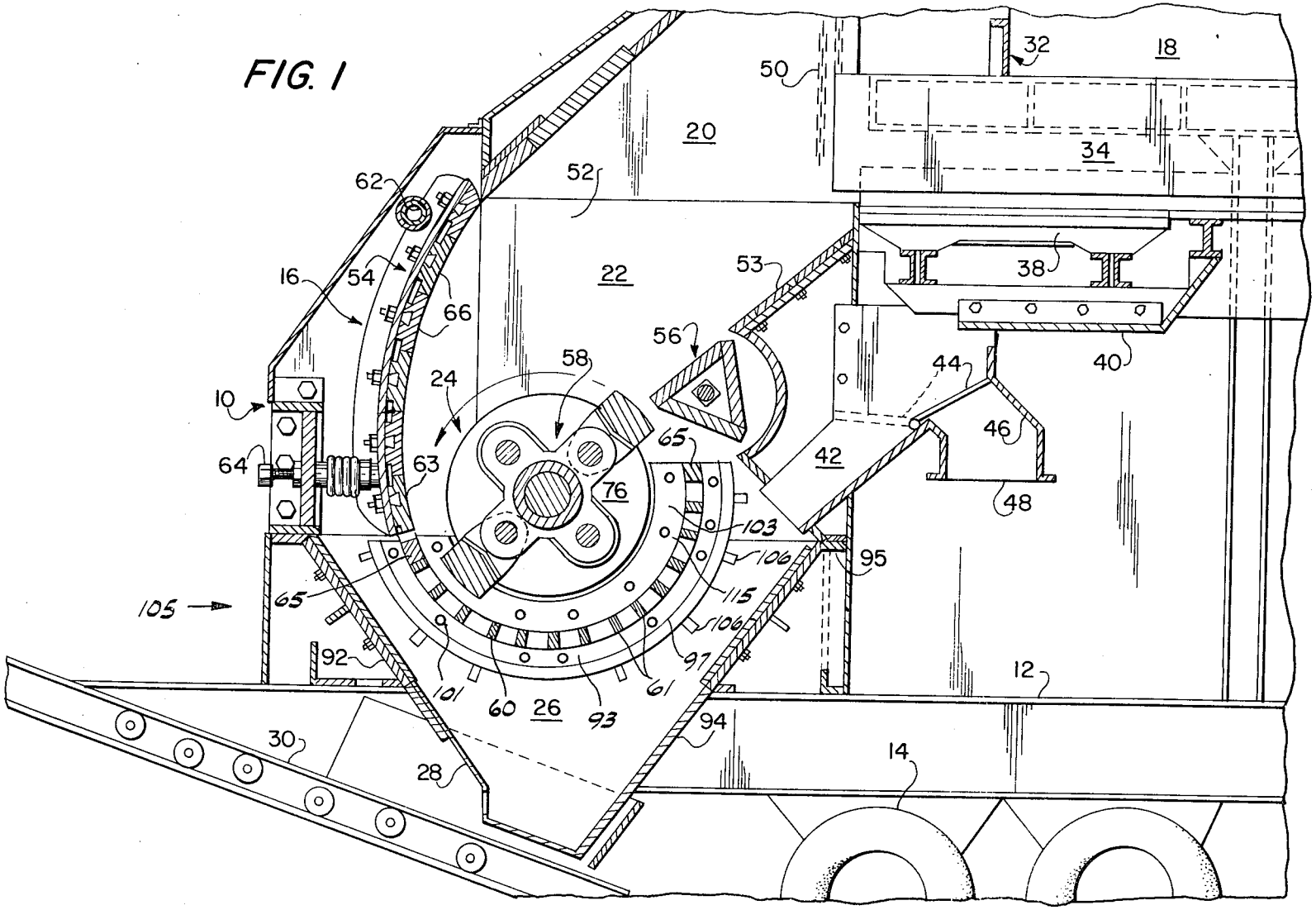

Referring now to the drawings and more particularly to FIG. 1, reference numeral 10 generally designates a rock crusher in accordance with the invention supported, for example, on a pair of I-beams 12 which may form the chassis of a vehicle having wheels 14 in the case of a portable unit or which constitute part of the foundation in the case of a non-portable installation. The apparatus includes a housing 16 which is comprised of an inlet section 18, a cover section 20, a crushing chamber feed section 22, a crushing chamber 24, and a discharge chamber 26 in the lower portion 105 of the crusher, which has an exit opening 28 through which crushed material is discharged, for example, onto an endless belt discharge conveyor 30 which has its feed end located between the beams 12.

The inlet section 18 includes conventional units such as a hopper 32 which is designed for use with a side-approach highlift feed unit (not shown). Skirtboards 34 are provided at the lower sides of the inlet section and at the bottom of the inlet section are spaced, parallel "grizzly bars" or scalping bars 38 between which dirt and other fine materials introduced with the uncrushed rocks fall into a pan 40. From pan 40 the fines fall into a chute 42 and subsequently into the discharge chamber 26 when gate 44 is in the position shown in FIG. 1. Gate 44 may alternatively be moved to close off chute 42 so that the fines exit through chute 46 to be discharged exteriorly of the apparatus through discharge opening 48.

From the inlet section, the uncrushed rock passes through a throw chain curtain 50 into the cover section 20 and then downwardly into the crushing chamber inlet feed section 22. The inlet feed section 22 is defined by housing side walls 52, a downwardly inclined rear wall 53, and an adjustable breaker plate section 54.

A generally triangularly shaped rock dislodger 56 of the construction disclosed and claimed in my abovementioned U.S. Pat. No. 3,662,963 is preferably provided at the lower end of inclined rear wall 53 of the feed section. As described in my patent, occasionally rocks become lodged in the feed section and block the flow of rocks into the crushing chamber. The rock dislodger 56 is designed to be rotated selectively in order to dislodge any such rocks.

A rotor 58 is disposed in crushing chamber 24 above an adjustable grate 60.

The adjustable breaker plate 54 is swingable about an axis 62 adjacent its upper end, and its lower end 63 terminates adjacent one end of the grate 60 to provide a tangential continuation thereof. An adjustment bolt 64 journaled within the housing 16 is threadably connected to the lower end 63 of the breaker plate section to provide means for adjustment of the position of the lower end 63. The inner surface of the breaker plate section is formed by breaker bars 66.

Figure 3:
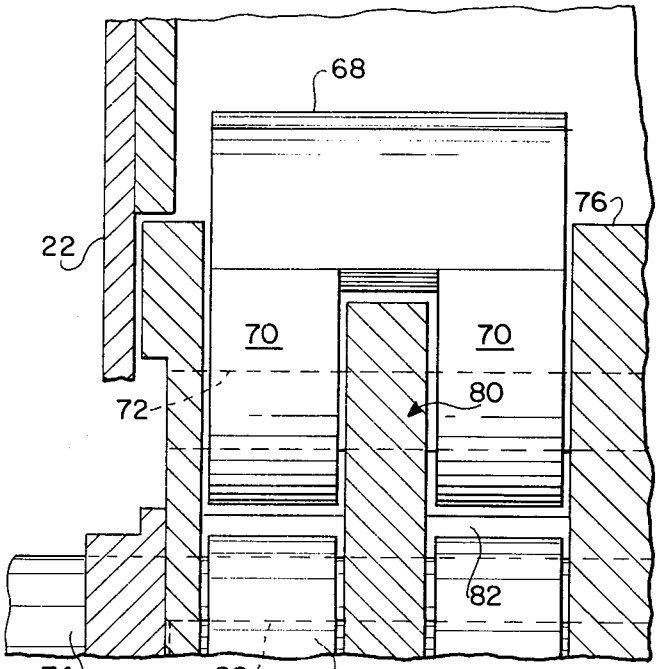
FIG. 3 is a partial longitudinal cross-sectional view of the rotor of the invention.
Figure 2:
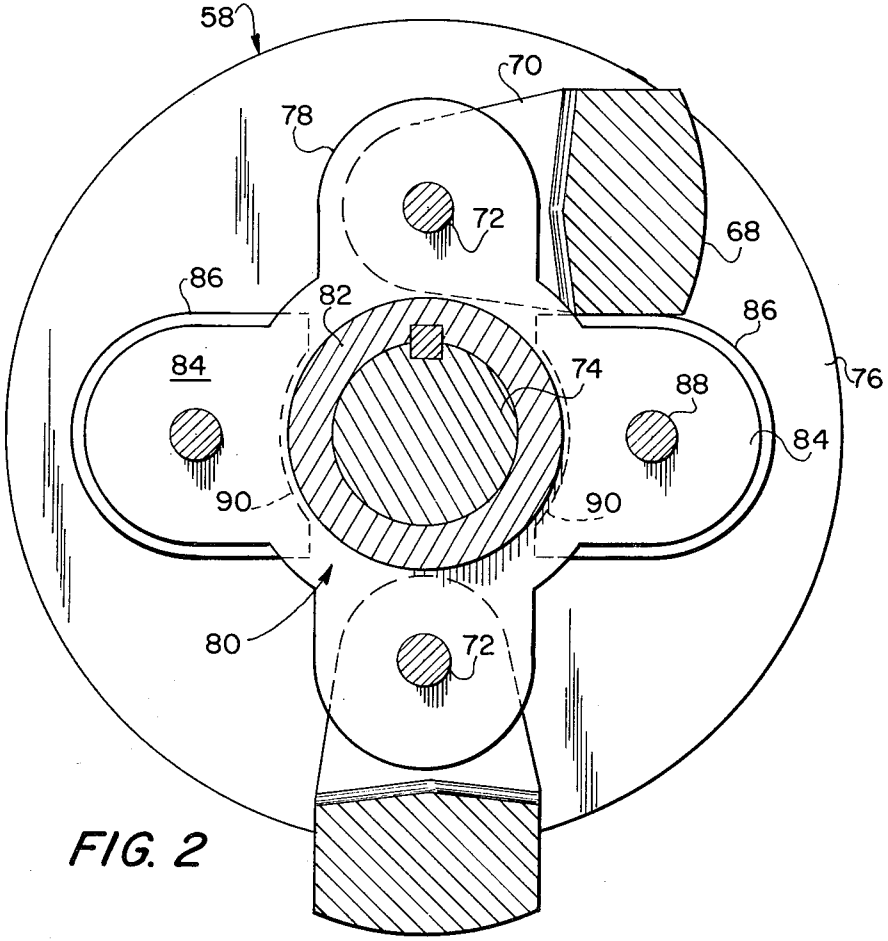
FIG. 2 is a transverse vertical cross-sectional view of the rotor of the invention.

Referring now to FIGS. 2 and 3, the details of rotor 58 will now be described. The operating elements of the rotor are stirrup shaped hammers having working surfaces 68. The hammers are preferably made of cast manganese steel and each may have a weight of approximately 300 pounds. Each hammer has a pair of lever arms 70 which are swingable through an arc of approximately 180° about pivot shafts 72. As shown there are two pivot shafts 72 spaced 180° apart on opposite sides of the main rotor shaft 74. From FIG. 3, it will be observed that on each shaft 72 there are a plurality of hammers spaced from each other by circular spacer plates or discs 76. Between the arms 70 of each hammer there is disposed one of the four arcuate lugs 78 of a four clover shaped disc 80 which has a spacer hub 82 splined to the main rotor shaft 74. There are thus two lugs 78 directly opposed to each other on each disc 80. The other "petals" of each disc 80 are a second pair of opposed arcuate lugs 84 which are spaced 90° from the arcuate lugs 78. Positioned between the arcuate lugs 84 of adjacent discs are bumper blocks 86 mounted on shafts 88 which extend through the arcuate lugs 84. As seen in FIG. 2, the bumper blocks 86 have generally the same configuration as lugs 84 but are somewhat larger, and also have inner surfaces 90 complementary shaped to the outer periphery of hubs 82. The shafts 72 on which the hammers are mounted as well as shafts 88 on which the bumper blocks are mounted pass through holes in the circular spacer discs 76 between the hammers and terminate in the spacer discs at opposite ends of the rotor assembly.

The above described rotor construction affords a number of advantages over conventional rotors. The provision of the spacer discs 76 functions to retain large feed rocks in the orbit of the hammers. In addition, the diameter of these spacer discs is selected to permit the hammers to move to an inoperative position such as that illustrated at the top of FIG. 2 when contacting an obstruction such as large tramp metal entering the apparatus with the feed rock.

The clover leaf construction of discs 80 permits the hammers to pivot through approximately 180°, and in addition increases the resistance of the hammer pivot shafts 72 to breakage by 100% over the same weight hammers lacking a center bearing provided by the lugs 78. This increase is due to providing four shear points on the shaft instead of two for each hammer. These four shear points are located on shaft 72 at each side of the two arms 70.

In normal operation, rotor 58 is rotated at a very high speed and the material to be crushed, such as limestone, is gravity fed from inlet section 18 through cover section 20 and feed section 22 into the crushing chamber 24. The rocks are broken up and pulverized by the combined action of hammer surfaces 68 striking the rocks and hurling them against breaker bars 66. The crushed particles are then passed through the apertures in grate 60, whose radial adjustment is more particularly described hereinafter, into discharge chamber 26. In discharge chamber 26 the crushed particles may be combined with any foreign material separated out through bars 38 and passed through chute 42 into discharge chamber 26. The discharged material from chamber 26 passes through exit opening 28 and is conveyed away by discharge conveyor 30.

Referring to FIG. 1, the discharge chamber 26 has inwardly sloping longitudinal walls 92,94. The upper ends of these walls are on a level with a joint flange 95 for supporting the crusher assembly. The discharge chamber thus extends upwardly to joint flange 95 enclosing most of the arcuate grate 60 so that the walls 92,94 may be at an angle of 50° or more with regard to the horizontal without materially increasing the overall height of the unit.

Figure 4:
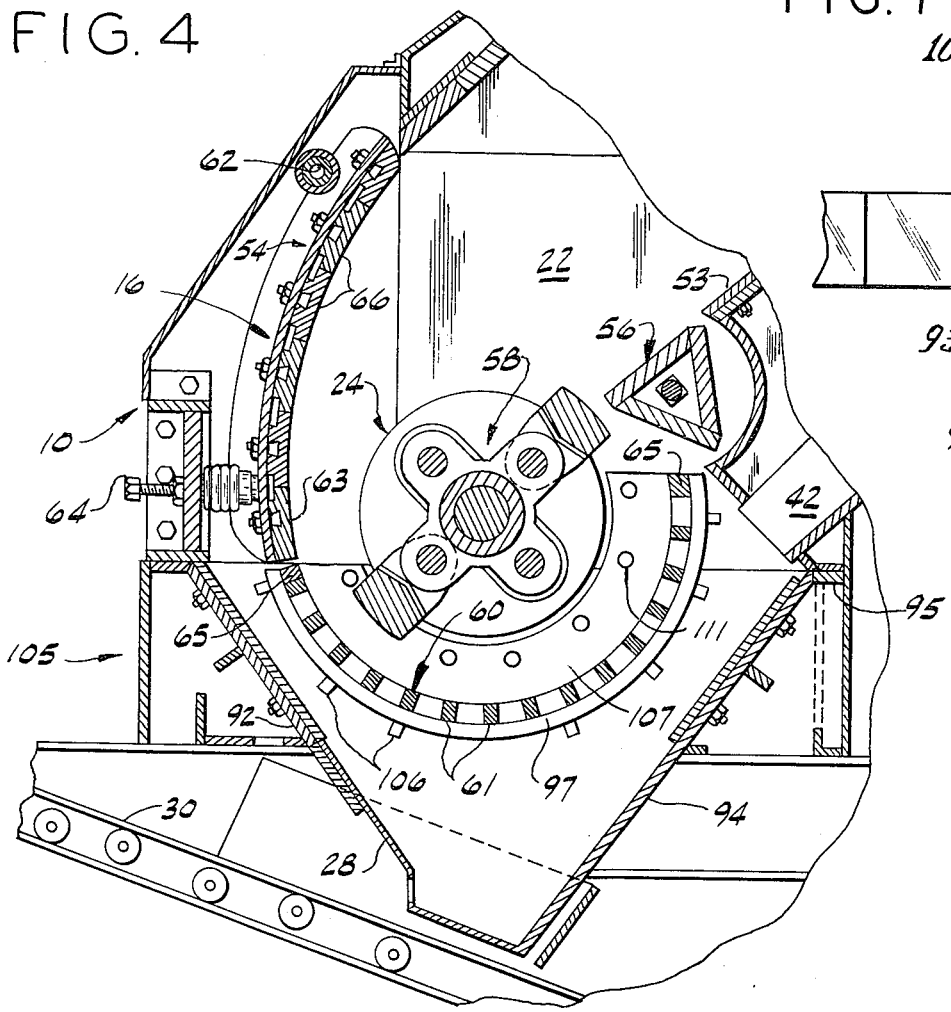
FIG. 4 is a fragmentary vertical cross-sectional view of the rock crusher shown in FIG. 1 but wherein the grate bars are supported on a conventional grate setting ledge.
Figure 7:
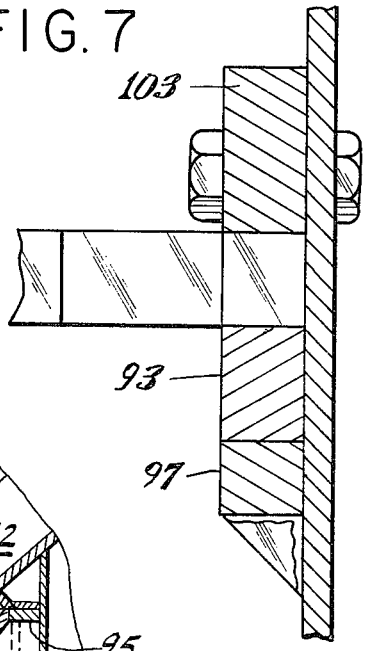
FIG. 7 is a fragmentary vertical cross-sectional view of a grate bar resting on the alternate grate setting ledge.
Figure 5:
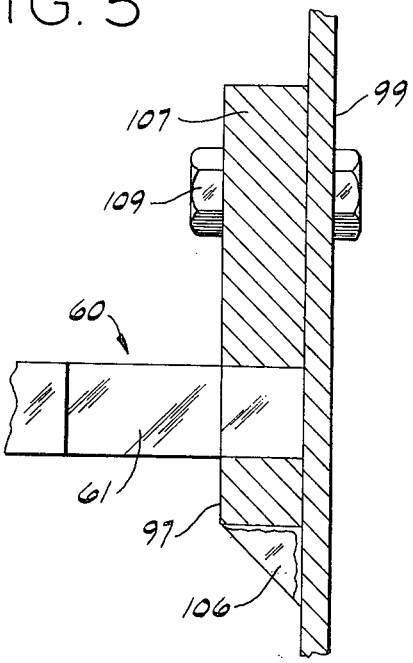
FIG. 5 is a fragmentary vertical cross-sectional view of a grate bar resting on the conventional grate setting ledge.
Figure 6:
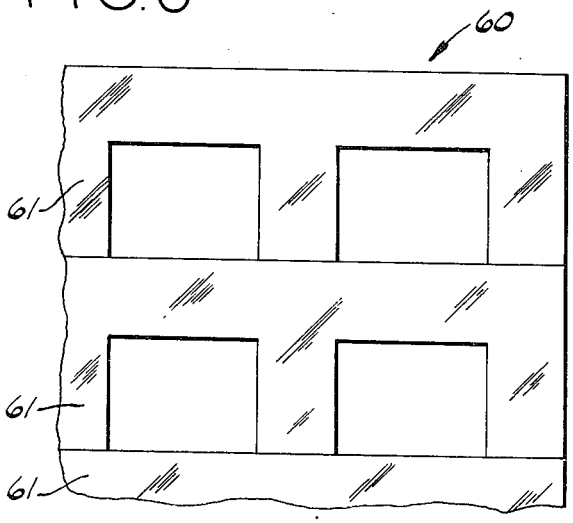
FIG. 6 is a fragmentary plan view of several grate bars.

As illustrated in FIGS. 1, 4 and 5, the arcuate grate 60 is formed of individual grate bars 61 and spacer bars 65 and is supported at opposite ends on an alternate grate setting ledge 93 (FIG. 1) or ordinary grate setting ledge 97 (FIGS. 4 and 5). Alternate grate setting ledge 93 is attached to side wall 99 by bolts (not shown) which are passed through an arcuate row of holes 101 for register with holes (not shown) in side wall 99. Grate 60 is held in place on alternate grate setting ledge 93 by a holddown liner 103 which is also secured to side wall 99 by means of holes 115.

When a greater gap between the top surface of grate 60 and the tips of the hammers is desired, alternate grate setting ledge 93 and hold-down liner 103 are removed. Grate 60 is then seated on ordinary grate setting ledge 97 which, as shown in FIG. 5, is welded to side wall 99 and further supported by knee brace 106, also welded to side wall 99. With grate 60 resting on ordinary grate setting ledge 97, alternate hold-down liner 107 is provided to retain grate 60 in place by attachment to side wall 99 by means of a bolt 109 through each of holes 111.

Thusly, the spacing between the arcuate grate 60 and the tips of the hammers may be adjusted substantially uniformly over the entire surface of the grate along a radius with respect to the rotor. It will be appreciated that when the grate is moved to its lower position, the lower end of breaker plate section 54 must be moved outwardly via adjustment bolt 64 until end 63 is again in alignment with the adjacent end of grate 60, It will also be appreciated that it will be necessary to add additional grate bars 61 or spacer or filler bars 65 to grate 60 so that no substantial gap is formed between end 63 and breaker plate section 54 and grate 60.

This adjustability of the grate overcomes the problem discussed earlier where following conventional practice the hammer may split particles in two against the next bar before the particles can fall through the openings in the grate. Thus, in accordance with the present invention greater flexibility in product particle size may be achieved.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A rock crusher comprising a housing forming a crushing chamber, means to feed rocks into said chamber, and a rotor having a main shaft extending longitudinally within said chamber, said rotor having at least two sets of hammers disposed thereon, pivot means to pivotally mount said hammers about pivot axes spaced from said main shaft and parallel thereto, each of said hammers comprising an outer working surface portion and a pair of inwardly extending arms supported at said pivot means, bumper means to limit the pivotal movement of said hammers, a first set of discs mounted on and rotatable with said main shaft, each disc having a first opposed pair of projections extending between the arms of a respective hammer and being connected thereto by said pivot means, each disc having a second pair of opposed projections, and means connecting said bumper means to said second pairs of projections.

2. A rock crusher according to claim 1, wherein said connecting means for said bumper means comprise shafts extending parallel to said main shaft through openings provided in said bumper means and in said second pairs of projections.

3. A rock crusher according to claim 1, further comprising a plurality of spacer discs mounted on said main shaft between the discs of said first set of discs and extending outwardly between adjacent hammers short of the normal position of the working surfaces of said hammers during normal operation, said hammers being pivotal to positions in which said hammers are located primarily inwardly of the outer surface of said discs.

4. A rock crusher according to claim 3, wherein said spacer discs are substantially circular, said discs being provided with apertures through which said pivot means for said hammers extend.

5. A rock crusher according to claim 1 wherein the housing has a generally horizontally extending upper inlet section, a crushing chamber feed section, a discharge chamber receiving crushed material passing through a grate, and means including chute means to receive fine materials and to convey said material to said discharge chamber.

6. A rock crusher according to claim 5, further comprising a chassis supporting said housing, said discharge chamber being within a pair of inwardly sloping walls, the upper ends of said walls extending above at least a substantial portion of said grate, and said walls having lower ends extending downwardly beneath the top surface of said chassis.

7. A rock crusher according to claim 6, further comprising wheel means connected to said chassis to make said housing portable.

8. Apparatus according to claim 5, further comprising grate adjustment means to uniformly adjust a gap provided between outer surfaces of said rotor and the adjacent surface of said grate over substantially the entire area of said grate.

* * * * *